US011153703B2

(12) United States Patent
Tu et al.

(10) Patent No.: US 11,153,703 B2
(45) Date of Patent: Oct. 19, 2021

(54) SPECIFIC SOUND SOURCE AUTOMATIC ADJUSTING METHOD AND ELECTRONIC DEVICE USING SAME

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/008,118

(22) Filed: Aug. 31, 2020

(65) Prior Publication Data

US 2021/0204083 A1 Jul. 1, 2021

(30) Foreign Application Priority Data

Dec. 31, 2019 (TW) ..... 108148594

(51) Int. Cl.
*H04S 7/00* (2006.01)

(52) U.S. Cl.
CPC ..... *H04S 7/302* (2013.01)

(58) Field of Classification Search
None
See application file for complete search history.

(56) References Cited

U.S. PATENT DOCUMENTS

2020/0107149 A1* 4/2020 Sunder ..... H04R 1/406
2020/0327877 A1* 10/2020 Tourbabin ..... G01S 3/802
2020/0412772 A1* 12/2020 Nesta ..... H04L 65/605

FOREIGN PATENT DOCUMENTS

CN 102799899 B 12/2014

OTHER PUBLICATIONS

Chi et al., "A frequency bin-wise nonlinear masking algorithm in convolutive mixtures for speech segregation", Journal of the Acoustical Society of America, vol. 131, No. 5, May 2012 (published online Apr. 9, 2012), pp. EL361-EL367 (8 pages total).

* cited by examiner

*Primary Examiner* — Paul W Huber
(74) *Attorney, Agent, or Firm* — Birch, Stewart, Kolasch & Birch, LLP

(57) ABSTRACT

A specific sound source automatic adjusting method and an electronic device using the same are provided. The electronic device includes a first audio recognition unit, a first multi-sound source determination unit, a directivity analysis unit, a directional separation unit, a second audio recognition unit, a second multi-sound source determination unit and an audio adjustment unit. If the number of sound sources of the original sound signal is larger than or equal to 2, the directivity analysis unit performs a directionality analysis procedure on the original sound signal. The directional separation unit separates out at least one specific directional sub-signal from the original sound signal according to the result of directional analysis procedure. If the number of sound sources of the specific directional sub-signal is equal to 1, the audio adjustment unit performs a sound source adjustment procedure.

20 Claims, 5 Drawing Sheets

SPECIFIC SOUND SOURCE AUTOMATIC ADJUSTING METHOD AND ELECTRONIC DEVICE USING SAME

This application claims the benefit of Taiwan application Serial No. 108148594, filed Dec. 31, 2019, the subject matter of which is incorporated herein by reference.

BACKGROUND OF THE INVENTION

Field of the Invention

The invention relates in general to an automatic adjusting method and an electronic device using the same, and more particularly to a specific sound source automatic adjusting method and an electronic device using the same.

Description of the Related Art

Along with the advance in technology, various audio/video entertainment devices are provided one after another. For the audio/video entertainment devices, the audio signal directly affects the user's sensations. To provide the user with better sensations, one specific sound source in the original sound signal needs to be amplified.

According to the conventional technology, the entire original sound signal is amplified when the specific sound source is detected. Despite increasing the user's sense of presence, such processing method does not do much good to the user, and the signal to noises ratio (SNR) still does not change because the background music and other sound sources are synchronously adjusted and amplified. Therefore, it has become a prominent task for the people in the technology field to provide a method or device for suitably adjusting specific sound source and increasing the SNR without affecting other sound sources.

SUMMARY OF THE INVENTION

The invention is directed to a specific sound source automatic adjusting method and an electronic device using the same. Through the technologies of determining the number of sound sources and separating the sound sources, the specific sound source is automatically adjusted, and the original sound signal is converted to an adjusted audio signal which is outputted to the headphone to provide the user with better sensations.

According to one embodiment of the present invention, a specific sound source automatic adjusting method is provided. The specific sound source automatic adjusting method includes the following steps. A probabilistic identification process of several specific sound sources is performed on an original sound signal. The number of sound sources of the original sound signal is determined according to the result of the probabilistic identification process on the original sound signal. If the number of sound sources of the original sound signal is greater than or equal to two, a directionality analysis procedure is performed on the original sound signal. At least one specific directional sub-signal is separated out from the original sound signal according to the result of the directional analysis procedure. The probabilistic identification process of the specific sound sources is performed on the specific directional sub-signal. The number of sound sources of the specific directional sub-signal is determined according to the result of the probabilistic identification process on the specific directional sub-signal. If the number of sound sources of the specific directional sub-signal is equal to one, a sound source adjustment procedure is performed.

According to another embodiment of the present invention, an electronic device for automatically adjusting a specific sound source is provided. The electronic device includes a first audio recognition unit, a first multi-sound source determination unit, a directivity analysis unit, a directional separation unit, a second audio recognition unit, a second multi-sound source determination unit and an audio adjustment unit. The first audio recognition unit is configured to perform a probabilistic identification process of several specific sound sources on an original sound signal. The first multi-sound source determination unit is configured to determine the number of sound sources of the original sound signal according to the result of the probabilistic identification process on the original sound signal. If the number of sound sources of the original sound signal is greater than or equal to two, the directivity analysis unit performs a directionality analysis procedure on the original sound signal. The directional separation unit is configured to separate out at least one specific directional sub-signal from the original sound signal according to the result of the directional analysis procedure. The second audio recognition unit is configured to perform the probabilistic identification process of the specific sound sources on the specific directional sub-signal. The second multi-sound source determination unit is configured to determine the number of sound sources of the specific directional sub-signal according to the result of the probabilistic identification process on the specific directional sub-signal. If the number of sound sources of the specific directional sub-signal is equal to one, the audio adjustment unit performs a sound source adjustment procedure.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
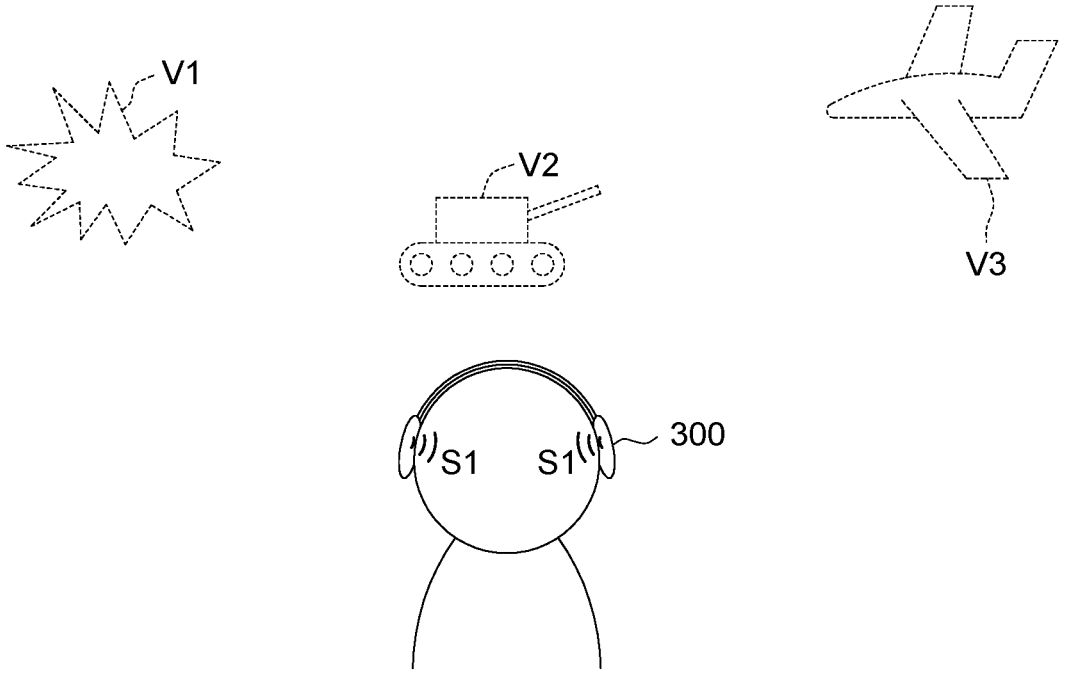
FIG. 1 is a schematic diagram of an original sound signal.

Referring to FIG. 1, a schematic diagram of an original sound signal S1 is shown. The user wears a headphone 300, which receives an original sound signal S1 (such as a dual-channel signal), can sense specific sound sources V1, V2, and V3 coming from different directions. For example, the specific sound source V1 is such as bombardment sound, the specific sound source V2 is such as tank sound, and the specific sound source V3 is such as airplane sound. Conventionally, if the bombardment sound needs to be amplified, the entire original sound signal S1 is amplified when the bombardment sound is played. Since the background sound is amplified as well, the bombardment sound cannot be highlighted. Therefore, the specific sound source V1 needs to be separated out from the original sound signal S1.

Figure 2:
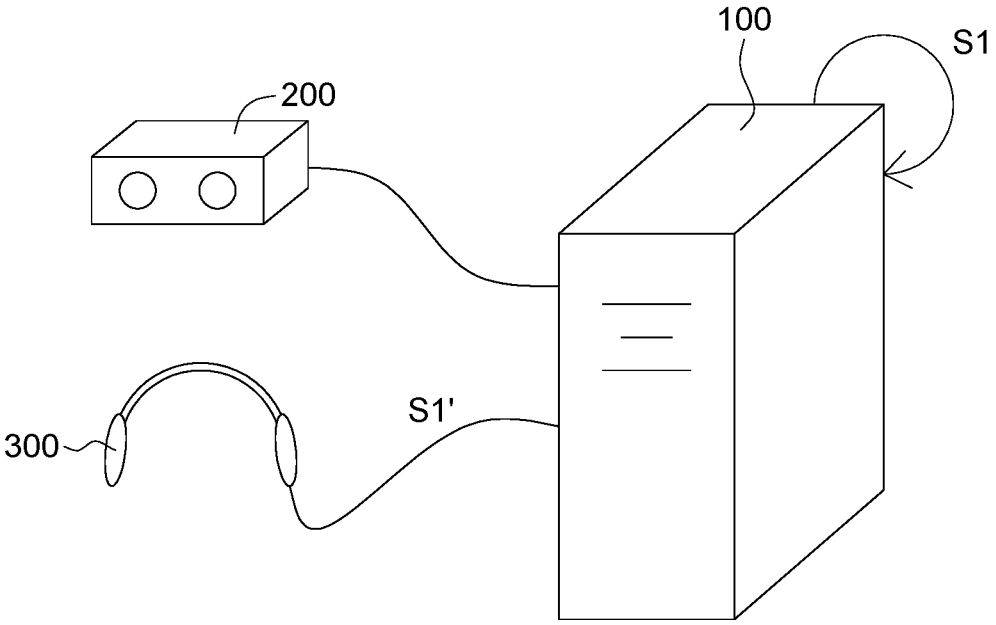
FIG. 2 is a schematic diagram of an electronic device for automatically adjusting a specific sound source according to an embodiment.
Figure 3:
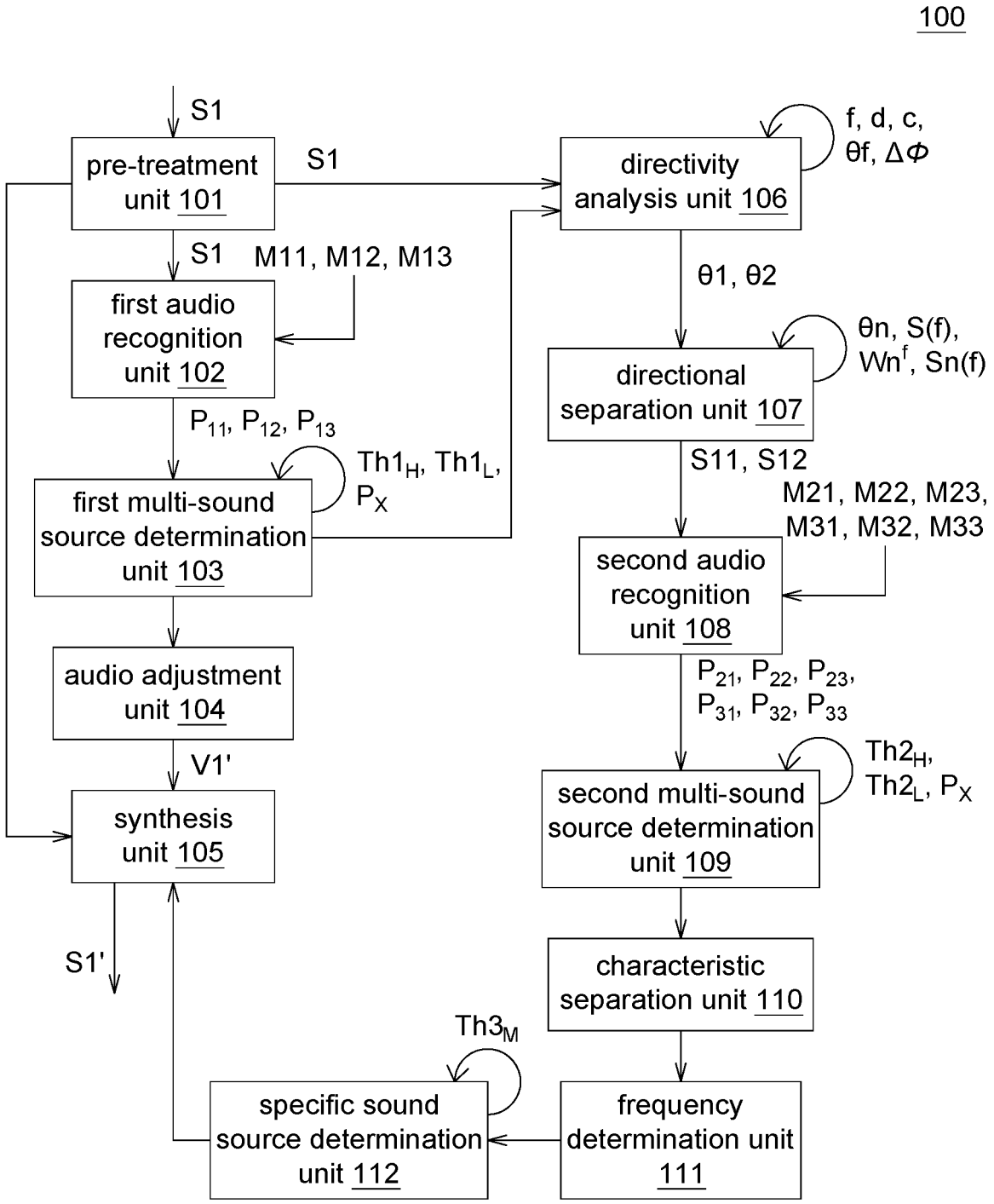
FIG. 3 is a block diagram of an electronic device for automatically adjusting a specific sound source according to an embodiment.

Refer to FIGS. 2 to 3. FIG. 2 is a schematic diagram of an electronic device for automatically adjusting a specific sound source 100 according to an embodiment. FIG. 3 is a block diagram of an electronic device for automatically adjusting a specific sound source 100 according to an embodiment. The electronic device 100 can be realized by such as a host computer, a game console, a set-top box, a laptop, or a server. The electronic device 100 is connected to a headphone 300 and a head-mounted display device 200. Referring to FIG. 3, a block diagram of an electronic device 100 according to an embodiment is shown. The electronic device 100 includes a pre-treatment unit 101, a first audio recognition unit 102, a first multi-sound source determination unit 103, an audio adjustment unit 104, a synthesis unit 105, a directivity analysis unit 106, a directional separation unit 107, a second audio recognition unit 108, a second multi-sound source determination unit 109, a characteristic separation unit 110, a frequency determination unit 111 and a specific sound source determination unit 112. The pre-treatment unit 101, the first audio recognition unit 102, the first multi-sound source determination unit 103, the audio adjustment unit 104, the synthesis unit 105, the directivity analysis unit 106, the directional separation unit 107, the second audio recognition unit 108, the second multi-sound source determination unit 109, the characteristic separation unit 110, the frequency determination unit 111 and the specific sound source determination unit 112 can be realized by such as circuits, chips, circuit boards, array codes, or storage devices for storing code. Through the technologies of determining the number of sound sources and separating the sound sources, the electronic device 100 of the present embodiment automatically adjusts the specific sound source V1 as an adjusted specific sound source V1', and further synthesizes the adjusted specific sound source V1' with the original sound signal S1 to obtain an adjusted audio signal S1'. Then, the adjusted audio signal S1' is outputted to the headphone 300 to provide the user with better sensations. The operations of each of the elements disclosed above are explained below with accompanying flowcharts.

Figure 4A:
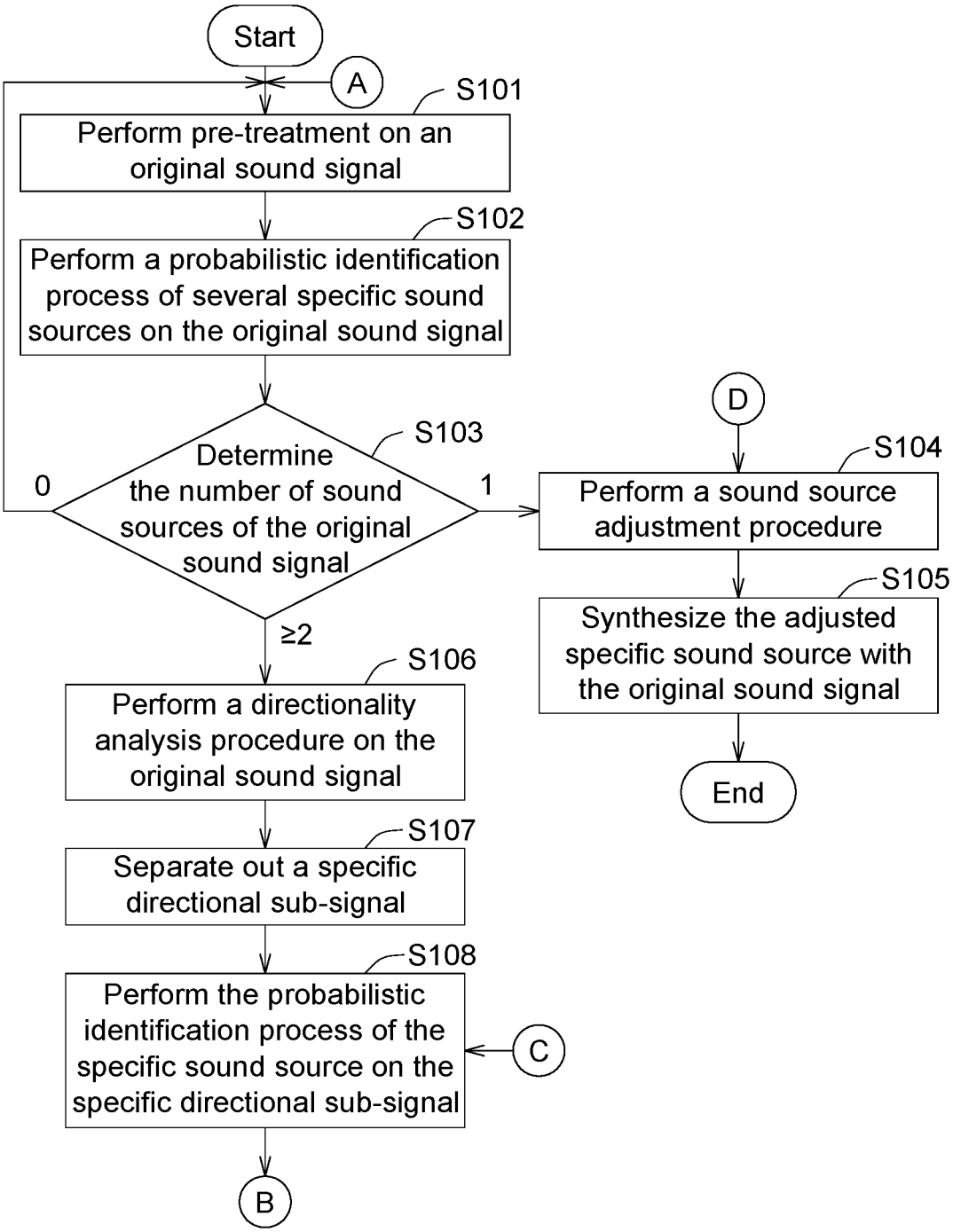
FIGS. 4A to 4B show a flowchart of a specific sound source automatic adjusting method according to an embodiment.
Figure 4B:
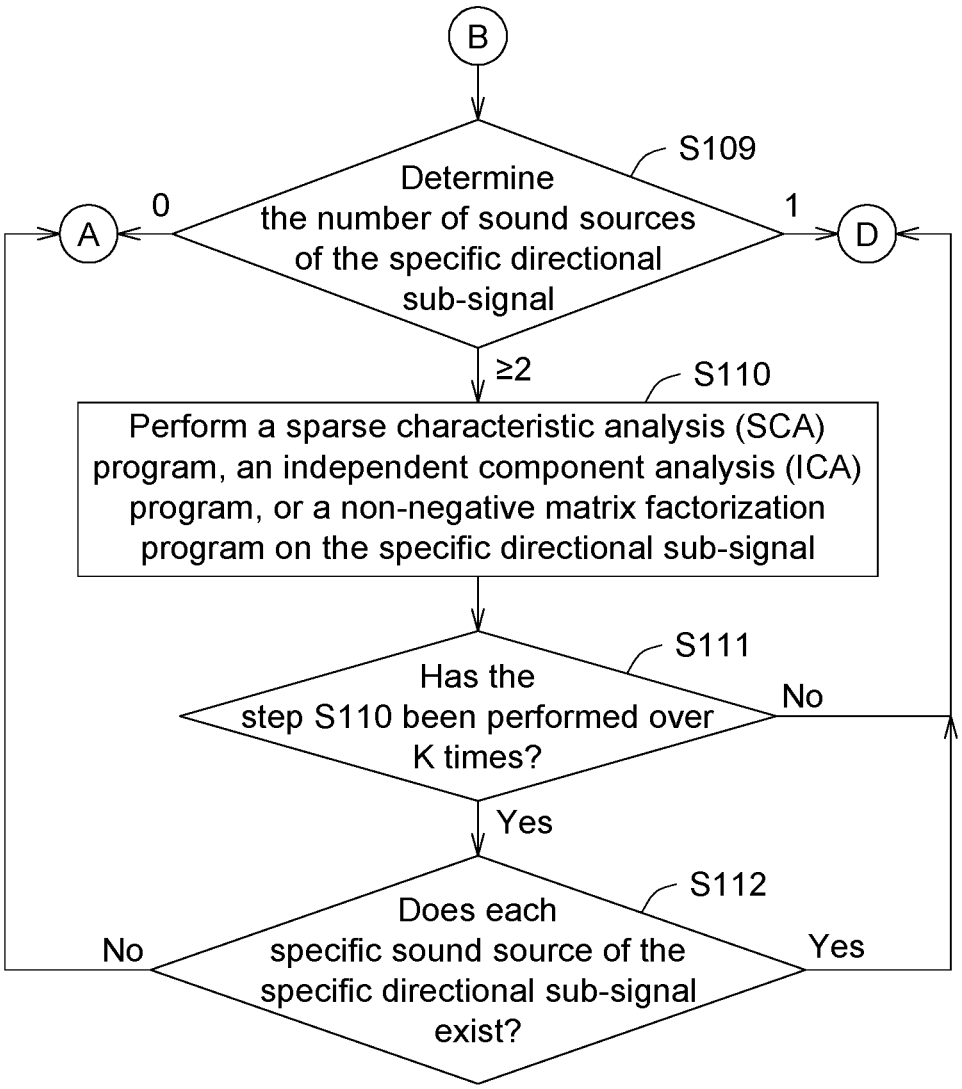

Referring to FIGS. 4A to 4B, a flowchart of a specific sound source automatic adjusting method according to an embodiment is shown. In step S101, a pre-treatment is performed on the original sound signal S1 by the pre-treatment unit 101 to obtain a characteristic function (such as zero crossing rate, energy, and Mel-frequency cepstral coefficient) suitable for performing audio recognition.

Then, the method proceeds to step S102, a probabilistic identification process of several specific sound sources V1, V2 and V3 is performed on the original sound signal S1 by the first audio recognition unit 102. For example, the first audio recognition unit 102 performs recognition by using a recognition model M11 trained with bombardment sound to obtain a sound source probability $P_{11}$ of the specific sound source V1; the first audio recognition unit 102 performs recognition by using a recognition model M12 trained with tank sound to obtain a sound source probability $P_{12}$ of the specific sound source V2; and the first audio recognition unit 102 performs recognition by using a recognition model M13 trained with airplane sound to obtain a sound source probability $P_{13}$ of the specific sound source V3.

Then, the method proceeds to step S103, the number of sound sources of the original sound signal S1 is determined by the first multi-sound source determination unit 103 according to the result of the probabilistic identification process on the original sound signal S1.

When the original sound signal S1 has only one specific sound source, the sound source probability of the specific sound source will be extremely high, and so will the maximum probability sound source probability be extremely high. When the original sound signal S1 has several specific sound sources (the background sound source is also a specific sound source), the sound source probability of each specific sound source will decrease, and the maximum probability sound source probability will not be too high. When the original sound signal S1 does not have any specific sound source, the sound source probability of each specific sound source will be extremely low, and so will the maximum probability sound source probability be extremely low.

That is, the first multi-sound source determination unit 103 can obtain the maximum probability $P_x$ from the sound source probabilities $P_{11}$, $P_{12}$, $P_{13}$ of the specific sound sources V1, V2 and V3 according to formula (1). Then, the number of specific sound sources is determined according to the maximum probability $P_x$.

$$P_x = \max_m P_m \tag{1}$$

The first multi-sound source determination unit 103 can set a higher threshold $Th1_H$ (such as 0.95) and a lower threshold $Th1_L$ (such as 0.1). When the original sound signal has only one specific sound source, the maximum probability $P_x$ will be higher than the higher threshold $Th1_H$. When the original sound signal has only one specific sound source and contains background music, the maximum probability $P_x$ will be between the higher threshold $Th1_H$ and the lower threshold $Th1_L$. When the original sound signal has more than two specific sound sources, the maximum probability $P_x$ will be between the higher threshold $Th1_H$ and the lower threshold $Th1_L$. When the original sound signal does not have any specific sound source, the maximum probability $P_x$ will be lower than the lower threshold $Th1_L$.

If the determination in step S103 is "the number of sound sources is 0", the method returns to step S101 in which no adjustment is performed; if the determination in step S103 is "the number of sound sources is 1", the method proceeds to step S104 to adjust the specific sound source; and if the determination in step S103 is "the number of sound sources is more than 2", the method proceeds to step S106 to continue with the separation of sound sources.

In step S104, a sound source adjustment procedure is performed by the audio adjustment unit 104. For example, the audio adjustment unit 104 obtains an adjusted specific sound source V1' by adjusting the volume of the specific sound source V1 or changing its frequency response via an equalizer (EQ).

In step S105, the adjusted specific sound source V1' is synthesized with the original sound signal S1 by the synthesis unit 105 to obtain an adjusted audio signal S1'.

If the determination in step S103 is "the number of sound sources is more than 2", the method proceeds to step S106 to continue with the separation of sound sources.

Figure 5:
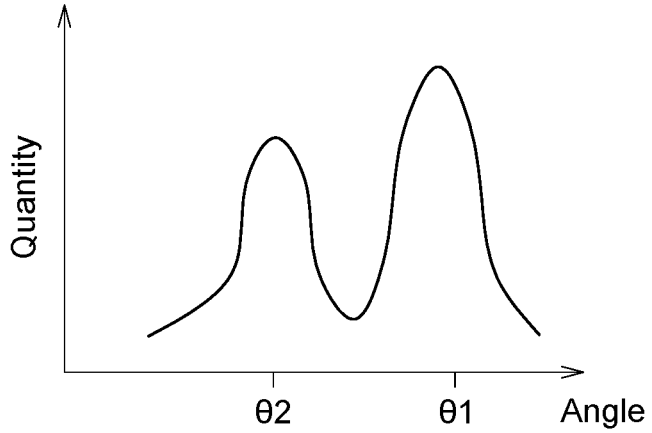
FIG. 5 is a directivity distribution diagram according to an embodiment.

In step S106, a directionality analysis procedure is performed on the original sound signal S1 by the directivity analysis unit 106. Referring to FIG. 5, a directivity distribution diagram according to an embodiment is shown. In the directionality analysis procedure, a directivity distribution diagram is obtained from the original sound signal S1 by using a direction of arrival (DOA) algorithm. The original sound signal S1 can be regarded as a left-ear audio signal and a right-ear audio signal. After the original sound signal S1 is converted to a frequency domain, the phase difference ΔØ of each frequency f is compared. The phase difference ΔØ is calculated according to formula (2) as follow:

$$\Delta\phi = \frac{2\pi f d \cos\theta_f}{c} \tag{2}$$

Wherein, the speed of sound c, the frequency f, and the binaural distance d are constants, and the only factor affecting the phase difference ΔØ is angle $\theta_f$. Each frequency f corresponds to an angle $\theta_f$. 1024 frequencies f may correspond to several angles $\theta_f$, and it is possible that several frequencies f may correspond to the same angle $\theta_f$. The directivity distribution diagram as illustrated in FIG. 5 can be created according to the distribution of the number of frequencies f corresponding to angles θ. Let FIG. 5 be taken for example. Since the number of the frequencies f corresponding to the angle θ1 or the angle θ2 is high, the original sound signal S1 may have a specific sound source at the angle θ1 and the angle θ2. However, it still cannot be confirmed that only one specific sound source exists in the angle θ1. Similarly, it still cannot be confirmed either whether only one specific sound source exists in the angle θ2.

Then, the method proceeds to step S107, at least one specific directional sub-signal is separated out from the original sound signal S1 by the directional separation unit 107 according to the result of the directional analysis procedure. For example, the directional separation unit 107 can separate out the specific directional sub-signal S11 corresponding to the angle θ1 and the specific directional sub-signal S12 corresponding to the angle θ2 from the original sound signal S1.

Figure 6:
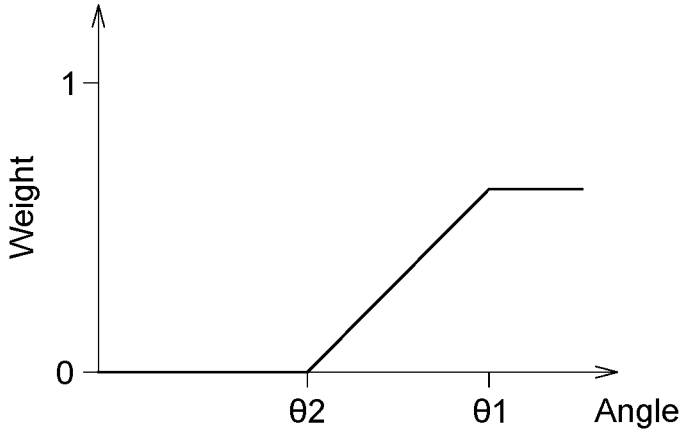
FIG. 6 is a schematic diagram of a nonlinear projection column mask corresponding to an angle.
Figure 7:
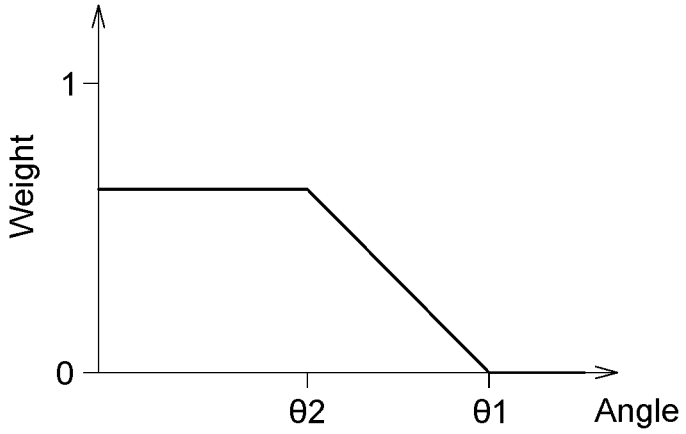
FIG. 7 is a schematic diagram of a nonlinear projection column mask corresponding to another angle.

In the present step, the directional separation unit 107 applies a nonlinear projection column mask (NPCM) on the original audio signal S1 according to a specific direction of the directivity distribution diagram to obtain specific directional sub-signals S11 and S12. Each frequency f corresponds to an angle θ. For the n-th signal, the closer to the angle $\theta_n$, the smaller (closer to 0) the assigned weight will be. The separation signal $S_n(f)$ towards the angle $\theta_n$ can be obtained by shielding the signal farther away from angle $\theta_n$ using different weights. That is, each frequency energy S(f) is multiplied by the corresponding weight $w_n^f$: $S_n(f)=w_n^f \times S(f)$. Refer to FIGS. 6 to 7. FIG. 6 is a schematic diagram of a nonlinear projection column mask corresponding to the angle θ1. FIG. 7 is a schematic diagram of a nonlinear projection column mask corresponding to the angle θ2. Through the above method, the specific directional sub-signal S11 corresponding to the angle θ1 and the specific directional sub-signal S12 corresponding to the angle θ2 can be separated out from the original sound signal S1.

Although the specific directional sub-signal S11 and the specific directional sub-signal S12 are separated out from the original sound signal S1 in step S107, many specific sound sources are probably located on the same direction, therefore the specific directional sub-signal S11 does not necessarily have only single specific sound source, and the specific directional sub-signal S12 does not necessarily have only single specific sound source either. Therefore, the number of sound sources still needs to be determined.

In step S108, the probabilistic identification process of the specific sound sources V1, V2 and V3 is performed on the specific directional sub-signals S11 and S12 respectively by the second audio recognition unit 108. Let the specific directional sub-signal S11 be taken for example. The second audio recognition unit 108 performs recognition to obtain a sound source probability $P_{21}$ of the specific sound source V1 by using a recognition model M21 trained with bombardment sound; the second audio recognition unit 108 performs recognition to obtain a sound source probability $P_{22}$ of the specific sound source V2 by using a recognition model M22 trained with tank sound; and the second audio recognition unit 108 performs recognition to obtain a sound source probability $P_{23}$ of the specific sound source V3 by using a recognition model M23 trained with airplane sound.

The recognition model M21 of step S108 can be the same as the recognition model M11 of step S102, or the recognition model M21 of step S108 can be the re-trained recognition model. The recognition model M22 of step S108 can be the same as the recognition model M12 of step S102, or the recognition model M22 of step S108 can be the re-trained recognition model. The recognition model M23 of step S108 can be the same as the recognition model M13 of step S102, or the recognition model M23 of step S108 can be the re-trained recognition model.

Let the specific directional sub-signal S12 be taken for example again. The second audio recognition unit 108 performs recognition to obtain a sound source probability $P_{31}$ of the specific sound source V1 by using a recognition model M31 trained with bombardment sound; the second audio recognition unit 108 performs recognition to obtain a sound source probability $P_{32}$ of the specific sound source V2 by using a recognition model M32 trained with tank sound; and the second audio recognition unit 108 performs recognition to obtain a sound source probability $P_{33}$ of the specific sound source V3 by using a recognition model M33 trained with airplane sound.

The recognition model M31 of step S108 can be the same as the recognition model M11 of step S102, or the recognition model M31 of step S108 can be the re-trained recognition model. The recognition model M32 of step S108 can be the same as the recognition model M12 of step S102, or the recognition model M32 of step S108 can be the re-trained recognition model. The recognition model M33 of step S108 can be the same as the recognition model M13 of step S102, or the recognition model M33 of step S108 can be the re-trained recognition model.

Then, the method proceeds to step S109, the number of sound sources of the specific directional sub-signal S11 and the number of sound sources of the specific directional sub-signal S12 are determined by the second multi-sound source determination unit 109 according to the result of the probabilistic identification process performed on the specific directional sub-signal S11 and the specific directional sub-signal S12 respectively.

The second multi-sound source determination unit 109 can set a new higher threshold $Th2_H$ (such as 0.99) and a new lower threshold $Th2_L$ (such as 0.05). If the determination in step S109 is "the number of sound sources is 1", the method proceeds to step S104 to adjust the specific sound source; if the determination in step S109 is "the number of sound sources is 2", the method proceeds to step S110 to continue with the separation of signal. For example, if the number of sound sources of the specific directional sub-signal S11 is 1, the specific directional sub-signal S11 is adjusted through step S104; if the number of sound sources of the specific directional sub-signal S11 is 2, the specific directional sub-signal S11 is separated through step S110.

In step S110, a sparse characteristic analysis (SCA) program, an independent component analysis (ICA) program, or a non-negative matrix factorization program is performed on the specific directional sub-signal S12 by the characteristic separation unit 110. Through the directional separation of step S107, all sound sources of the specific directional sub-signal S12 are on the same direction, and basically the specific directional sub-signal S12 does not have many sound sources. To avoid unnecessary distortion, the specific directional sub-signal S12 is only separated into two sub-signals. The specific directional sub-signal can be separated out by using the sparse characteristic analysis (SCA) method according to the sparsity of the sound band between individual sub-signals, or by using the independent component analysis (ICA) method according to the independence between sound sources, or by using the non-negative matrix factorization method which divides the signal into different bases corresponding to suitable coefficients.

After two sub-signals are separated in step S110, the method proceeds to step S111.

In step S111, whether step S110 has been performed over K times is determined by the frequency determination unit 111. If step S110 has been performed over K times, the method proceeds to step S112; otherwise, the method returns to step S108. That is, after the step S110 of separating the signal has been performed for many times, if it still cannot be accurately confirmed that the sub-signal has only one sound source, the method skips the loop and proceeds to step S112.

In step S112, whether each of the specific sound sources V1, V2 and V3 of the specific directional sub-signal S12 exists is directly determined by the specific sound source determination unit 112 according to the result of the probabilistic identification process on the specific directional sub-signal S12. The specific sound source determination unit 112 sets a middle threshold $Th3_M$ as 0.5. If the sound source probability $P_{31}$ of the specific sound source V1 is higher than the middle threshold $Th3_M$, the specific sound source determination unit 112 directly determines that the specific sound source V1 exists, and the method proceeds to step S104 to perform adjustment; if the sound source probability $P_{31}$ of the specific sound source V1 is not higher than the middle threshold $Th3_M$, the specific sound source determination unit 112 directly determines that the specific sound source V1 does not exist and there is no need to perform adjustment. If the sound source probability $P_{32}$ of the specific sound source V2 is higher than the middle threshold $Th3_M$, the specific sound source determination unit 112 directly determines that the specific sound source V2 exists, and the method proceeds to step S104 to perform adjustment; if the sound source probability $P_{32}$ of the specific sound source V2 is not higher than the middle threshold $Th3_M$, the specific sound source determination unit 112 directly determines that the specific sound source V2 does not exist and there is no need to perform adjustment. If the sound source probability $P_{33}$ of the specific sound source V3 is higher than the middle threshold $Th3_M$, the specific sound source determination unit 112 directly determines that the specific sound source V3 exists and the method proceeds to step S104 to perform adjustment; if the sound source probability $P_{33}$ of the specific sound source V3 is not greater than the middle threshold $Th3_M$, the specific sound source determination unit 112 directly determines that the specific sound source V3 does not exist and there is no need to perform adjustment.

Through the above embodiments, the specific sound sources can be separated and adjusted accordingly, such that the specific sound sources can be highlighted, and the user can be provided with better sensations.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A specific sound source automatic adjusting method, comprising:

performing a probabilistic identification process of a plurality of specific sound sources on an original sound signal;

determining a number of sound sources of the original sound signal according to a result of the probabilistic identification process on the original sound signal;

performing a directionality analysis procedure on the original sound signal if the number of sound sources of the original sound signal is greater than or equal to two;

separating out at least one specific directional sub-signal from the original sound signal according to a result of the directional analysis procedure;

performing the probabilistic identification process of the specific sound sources on the specific directional sub-signal;

determining a number of sound sources of the specific directional sub-signal according to a result of the probabilistic identification process on the specific directional sub-signal; and performing a sound source adjustment procedure if the number of sound sources of the specific directional sub-signal is equal to one.

2. The specific sound source automatic adjusting method according to claim 1, wherein in the step of determining the number of sound sources of the original sound signal, if a maximum probability of a plurality of sound source probabilities is between a higher threshold and a lower threshold, the number of sound sources of the original sound signal is greater than or equal to two.

3. The specific sound source automatic adjusting method according to claim 2, wherein in the step of determining the number of sound sources of the original sound signal, if the maximum probability of the sound source probabilities is higher than the higher threshold, the number of sound sources of the original sound signal is equal to one.

4. The specific sound source automatic adjusting method according to claim 2, wherein in the step of determining the number of sound sources of the original sound signal, if the maximum probability of the sound source probabilities is lower than the lower threshold, the number of sound sources of the original sound signal is equal to zero.

5. The specific sound source automatic adjusting method according to claim 1, wherein in the directionality analysis procedure, a directivity distribution diagram is obtained from the original sound signal by using a direction of arrival (DOA) algorithm.

6. The specific sound source automatic adjusting method according to claim 5, wherein the directivity distribution diagram is a distribution of frequencies corresponding to angles.

7. The specific sound source automatic adjusting method according to claim 1, wherein in the step of separating out the specific directional sub-signal, a nonlinear projection column mask (NPCM) is applied on the original audio signal to obtain the specific directional sub-signal according to a specific direction of the directivity distribution diagram.

8. The specific sound source automatic adjusting method according to claim 1, wherein the number of the at least one specific directional sub-signal is two.

9. The specific sound source automatic adjusting method according to claim 1, further comprising:

performing a sparse characteristic analysis (SCA) program, an independent component analysis (ICA) program, or a non-negative matrix factorization program on the specific directional sub-signal if the number of sound sources of the specific directional sub-signal is greater than or equal to two.

10. The specific sound source automatic adjusting method according to claim 1, further comprising:

performing the sound source adjustment procedure if the original audio signal the number of sound sources of is equal to one.

11. An electronic device, comprising:

a first audio recognition unit configured to perform a probabilistic identification process of the specific sound sources on an original sound signal;

a first multi-sound source determination unit configured to determine a number of sound sources of the original sound signal according to a result of the probabilistic identification process on the original sound signal;

a directivity analysis unit configured to perform a directionality analysis procedure on the original sound signal if the number of sound sources of the original sound signal is greater than or equal to two;

a directional separation unit configured to separate out at least one specific directional sub-signal from the original sound signal according to the result of the directional analysis procedure;

a second audio recognition unit configured to perform the probabilistic identification process of the specific sound sources on the specific directional sub-signal;

a second multi-sound source determination unit configured to determine a number of sound sources of the specific directional sub-signal according to a result of the probabilistic identification process on the specific directional sub-signal; and an audio adjustment unit configured to perform a sound source adjustment procedure if the number of sound sources of the specific directional sub-signal is equal to one.

12. The electronic device according to claim 11, wherein if a maximum probability of a plurality of sound source probabilities is between a higher threshold and a lower threshold, the number of sound sources of the original sound signal is greater than or equal to two.

13. The electronic device according to claim 2, wherein if the maximum probability of the sound source probabilities is higher than the higher threshold, the number of sound sources of the original sound signal is equal to one.

14. The electronic device according to claim 12, wherein if the maximum probability of the sound source probabilities is lower than the lower threshold, the number of sound sources of the original sound signal is equal to zero.

15. The electronic device according to claim 11, wherein a directivity distribution diagram is obtained from the original sound signal by using a direction of arrival (DOA) algorithm.

16. The electronic device according to claim 15, wherein the directivity distribution diagram is a distribution of frequencies corresponding to angles.

17. The electronic device according to claim 11, wherein a nonlinear projection column mask (NPCM) is applied on the original audio signal to obtain the specific directional sub-signal according to a specific direction of the directivity distribution diagram.

18. The electronic device according to claim 11, wherein the number of the at least one specific directional sub-signal is two.

19. The electronic device according to claim 11, further comprising:

a characteristic separation unit configured to perform a sparse characteristic analysis (SCA) program, an independent component analysis (ICA) program, or a non-negative matrix factorization program on the specific directional sub-signal if the number of sound sources of the specific directional sub-signal is greater than or equal to two.

20. The electronic device according to claim 11, wherein the audio adjustment unit is further configured to perform the sound source adjustment procedure if the original audio signal the number of sound sources of is equal to one.

* * * * *